US012209588B2

(12) United States Patent
Nishimori et al.

(10) Patent No.: US 12,209,588 B2
(45) Date of Patent: Jan. 28, 2025

(54) ELECTRIC COMPRESSOR

(71) Applicant: KABUSHIKI KAISHA TOYOTA JIDOSHOKKI, Aichi (JP)

(72) Inventors: Noritaka Nishimori, Kariya (JP); Toshiyuki Kobayashi, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 9 days.

(21) Appl. No.: 18/116,018

(22) Filed: Mar. 1, 2023

(65) Prior Publication Data

US 2023/0313798 A1 Oct. 5, 2023

(30) Foreign Application Priority Data

Mar. 9, 2022 (JP) ..... 2022-036085

(51) Int. Cl.
*F04C 29/06* (2006.01)

(52) U.S. Cl.
CPC ..... *F04C 29/06* (2013.01); *F04C 29/063* (2013.01); *F04C 2240/30* (2013.01)

(58) Field of Classification Search
CPC .... F04C 29/06; F04C 2240/30; F04C 29/063; F04C 18/344; F04C 18/0215; F04C 23/008; F04C 2240/80
See application file for complete search history.

(56) References Cited

U.S. PATENT DOCUMENTS 4,034,916 A * 7/1977 Forsberg ..... B05B 7/2494 220/4.21
2012/0308414 A1* 12/2012 Ogawa ..... F04B 39/064 417/410.5
2018/0023568 A1* 1/2018 Kang ..... F04C 23/008 361/689

FOREIGN PATENT DOCUMENTS

CN 213754184 U * 7/2021
JP a JPH05-321839 A 12/1993
JP b JP2013-053815 A 3/2013
JP C JP2013-053771 A 3/2013
JP d JP2013-194673 A 9/2013

OTHER PUBLICATIONS

English Translation of CN 213754184 (Year: 2021).*

* cited by examiner

*Primary Examiner* — Dominick L Plakkoottam
(74) *Attorney, Agent, or Firm* — Greenblum & Bernstein, P.L.C.

(57) ABSTRACT

An electric compressor includes a compression member compressing fluid drawn from a suction chamber and discharging the compressed fluid to a discharge chamber, an electric motor driving the compression member, an inverter driving the electric motor, a housing in which the suction chamber and the discharge chamber are formed and that accommodates the compression member, the electric motor, and the inverter, the housing including an inverter accommodation portion, a soundproof cover covering an outer surface of the housing, and a nameplate including predetermined information. The nameplate is provided on at least one of a first outer surface of the outer surface corresponding to the inverter accommodation portion and a second outer surface of the outer surface corresponding to the discharge portion. The soundproof cover has a window through the nameplate is viewed and which is formed in a part of the soundproof cover corresponding to the nameplate.

7 Claims, 4 Drawing Sheets

ELECTRIC COMPRESSOR

CROSS-REFERENCE TO RELATED APPLICATION

This application claims priority to Japanese Patent Application No. 2022-036085 filed on Mar. 9, 2022, the entire disclosure of which is incorporated herein by reference.

BACKGROUND ART

The present disclosure relates to an electric compressor.

The electric compressor includes a compression member, an electric motor, an inverter, and a housing. The compression member compresses fluid. The electric motor drives the compression member. The inverter drives the electric motor. The housing accommodates the compression member, the electric motor, and the inverter. The housing is made of metal.

In this electric compressor, vibration and noise may be generated by operations of the compression member and the electric motor. When vibration and noise are generated inside the housing, the vibration of the housing occurs. Thus, radiation noise is generated from the housing. As disclosed in Japanese Patent Application Publication No. H05-321839, covering an outer surface of the housing with a soundproof cover has been considered for such a problem. The soundproof cover absorbs the radiation noise from the housing. As a result, the noise of the electric compressor is suppressed.

In this electric compressor, a nameplate is attached to the outer surface of the housing in some cases. The nameplate includes predetermined information such as a product number of the electric compressor, a lot number of the electric compressor at the time of manufacture, and precautions for use of the electric compressor. However, when the outer surface of the cover is covered with the soundproof cover as disclosed in the above-cited Publication, the nameplate cannot be checked from outside the electric compressor.

For example, attaching the nameplate to the outer surface of the soundproof cover may be considered. However, when the soundproof cover is made of a resin material such as a urethane material, the nameplate cannot be appropriately attached to the outer surface of the soundproof cover unless an adhesive suitable for the resin material is used. That is, when the soundproof cover is made of a resin material, the nameplate may not be stably attached to the soundproof cover when being attached to the outer surface of the soundproof cover.

In addition, when the outer surface of the housing is covered with the soundproof cover, the heat release performance of the housing is reduced in the electric compressor. Therefore, increasing the heat release performance of the housing is desired.

SUMMARY

In accordance with an aspect of the present disclosure, there is provided an electric compressor including a compression member configured to compress fluid drawn from a suction chamber and discharge the compressed fluid to a discharge chamber, an electric motor configured to drive the compression member, an inverter configured to drive the electric motor, a housing in which the suction chamber and the discharge chamber are formed and that accommodates the compression member, the electric motor, and the inverter, and a soundproof cover configured to cover an outer surface of the housing, a nameplate including predetermined information, the housing including an inverter accommodation portion accommodating the inverter, and a discharge portion forming the discharge chamber. The nameplate is provided on at least one of a first outer surface of the outer surface corresponding to the inverter accommodation portion and a second outer surface of the outer surface corresponding to the discharge portion. The soundproof cover has a window formed in a part of the soundproof cover corresponding to the nameplate to see the nameplate.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

First Embodiment

The following will describe an embodiment of an electric compressor according to a first embodiment with reference to FIGS. 1 to 4. The electric compressor of the present embodiment is, for example, used for a vehicle air conditioner.

<Configuration of Electric Compressor>

Figure 1:
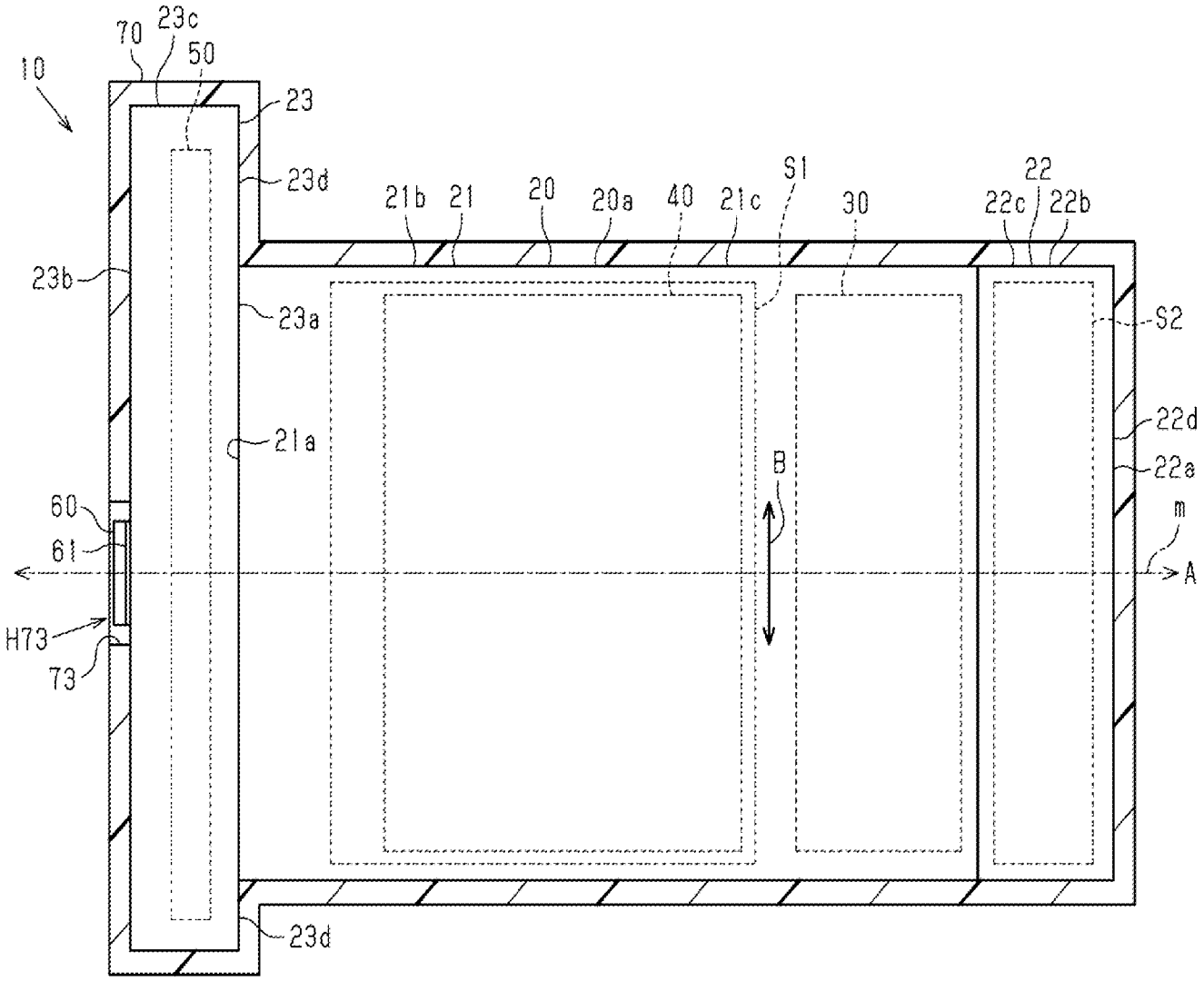
FIG. 1 is a cross-sectional view of an electric compressor according to a first embodiment.

As illustrated in FIG. 1, the electric compressor 10 includes a housing 20, a compression member 30, an electric motor 40, an inverter 50, a nameplate 60, and a soundproof cover 70.

The compression member 30 is configured to compress refrigerant as fluid. The compression member 30 is a scroll type compression member that includes a fixed scroll and a movable scroll, which are not illustrated. The compression member 30 compresses refrigerant introduced to the housing 20 with the operation of the electric motor 40.

The electric motor 40 drives the compression member 30. The inverter 50 drives the electric motor 40. The housing 20 accommodates the compression member 30, the electric motor 40, and the inverter 50. The nameplate 60 is attached to the housing 20. The soundproof cover 70 covers an outer surface 20*a* of the housing 20.

<Configuration of Housing>

The housing 20 has a tubular shape. The housing 20 is made of metal. For example, the housing 20 is made of aluminum. A direction in which an axial line m of the housing 20 extends is referred to as an axial direction A. A direction extending perpendicular to the axial line m of the housing 20 is referred to as a radial direction B. The housing 20 includes a first housing member 21, a second housing member 22, and a third housing member 23.

The first housing member 21 includes an end wall 21*a* and a peripheral wall 21*b*. The peripheral wall 21*b* has a cylindrical shape. The peripheral wall 21*b* extends from an outer peripheral portion of the end wall 21*a*. An axial line of the peripheral wall 21*b* coincides with the axial line m of the housing 20. The peripheral wall 21*b* has an outer peripheral surface 21*c*. The first housing member 21 accommodates the compression member 30 and the electric motor 40.

A suction chamber S1 is formed inside the first housing member 21. Refrigerant to be compressed in the compression member 30 is drawn into the suction chamber S1. The suction chamber S1 is a space surrounded by the end wall 21*a* and the peripheral wall 21*b*. The suction chamber S1 also serves as a motor chamber in which the electric motor 40 is accommodated.

The second housing member 22 includes an end wall 22*a* and a peripheral wall 22*b*. The peripheral wall 22*b* has a cylindrical shape. The peripheral wall 22*b* extends from an outer peripheral portion of the end wall 22*a*. The peripheral wall 22*b* has an outer peripheral surface 22*c*. The end wall 22*a* has an outer surface 10) 22*d*. The outer surface 22*d* is continuous with the outer peripheral surface 22*c*.

The first housing member 21 and the second housing member 22 are connected in the axial direction A. The first housing member 21 and the second housing member 22 are fixed with bolts (not illustrated). An end of the peripheral wall 21*b* on a side opposite to the end wall 21*a* abuts an end of the peripheral wall 22*b* on a side opposite to the end wall 22*a* in the axial direction A.

A discharge chamber S2 is formed inside the second housing member 22. Refrigerant compressed in the compression member 30 is discharged to the discharge chamber S2. The second housing member 22 corresponds to a discharge portion forming the discharge chamber S2. The suction chamber S1 and the discharge chamber S2 are formed in the housing 20. The compression member compresses refrigerant drawn from the suction chamber S1 and discharges the compressed refrigerant to the discharge chamber S2.

The third housing member 23 is connected to the first housing member 21 in the axial direction A. The third housing member 23 is connected to the end wall 21*a* of the first housing member 21. The first housing member 21 and the third housing member 23 are fixed with bolts (not illustrated). The third housing member 23 has a shape that projects out in the radial direction B relative to the first housing 30 member 21. The third housing member 23 accommodates the inverter 50. The third housing member 23 corresponds to an inverter accommodation portion accommodating the inverter 50.

The third housing member 23 has a first surface 23*a*, a second surface 23*b*, and a third surface 23*c*. The first surface 23*a* is in contact with the end wall 21*a*. The first surface 23*a* has an exposed surface 23*d* that is not in contact with the end wall 21*a*. The second surface 23*b* is a surface opposite to the first surface 23*a* in the axial direction A. The third surface 23*c* is a surface connecting the first surface 23*a* to the second surface 23*b*.

<Outer Surface of Housing>

An outer surface 20*a* of the housing 20 forms an outline of the electric compressor 10. The outer surface 20*a* includes the outer peripheral surfaces 21*c*, 22*c*, the outer surface 22*d*, the second surface 23*b*, the third surface 23*c*, and the exposed surface 23*d*. That is, the outer surface 20*a* of the housing 20 is a surface exposed to an outside when being not covered with the soundproof cover 70.

The second surface 23*b*, the third surface 23*c*, and the exposed surface 23*d* correspond to a first outer surface that is a part of the outer surface 20*a* corresponding to the inverter accommodation portion. The outer peripheral surface 22*c* and the outer surface 22*d* correspond to a second outer surface that is a part of the outer surface 20*a* corresponding to the discharge portion.

<Configuration of Nameplate>

Figure 2:
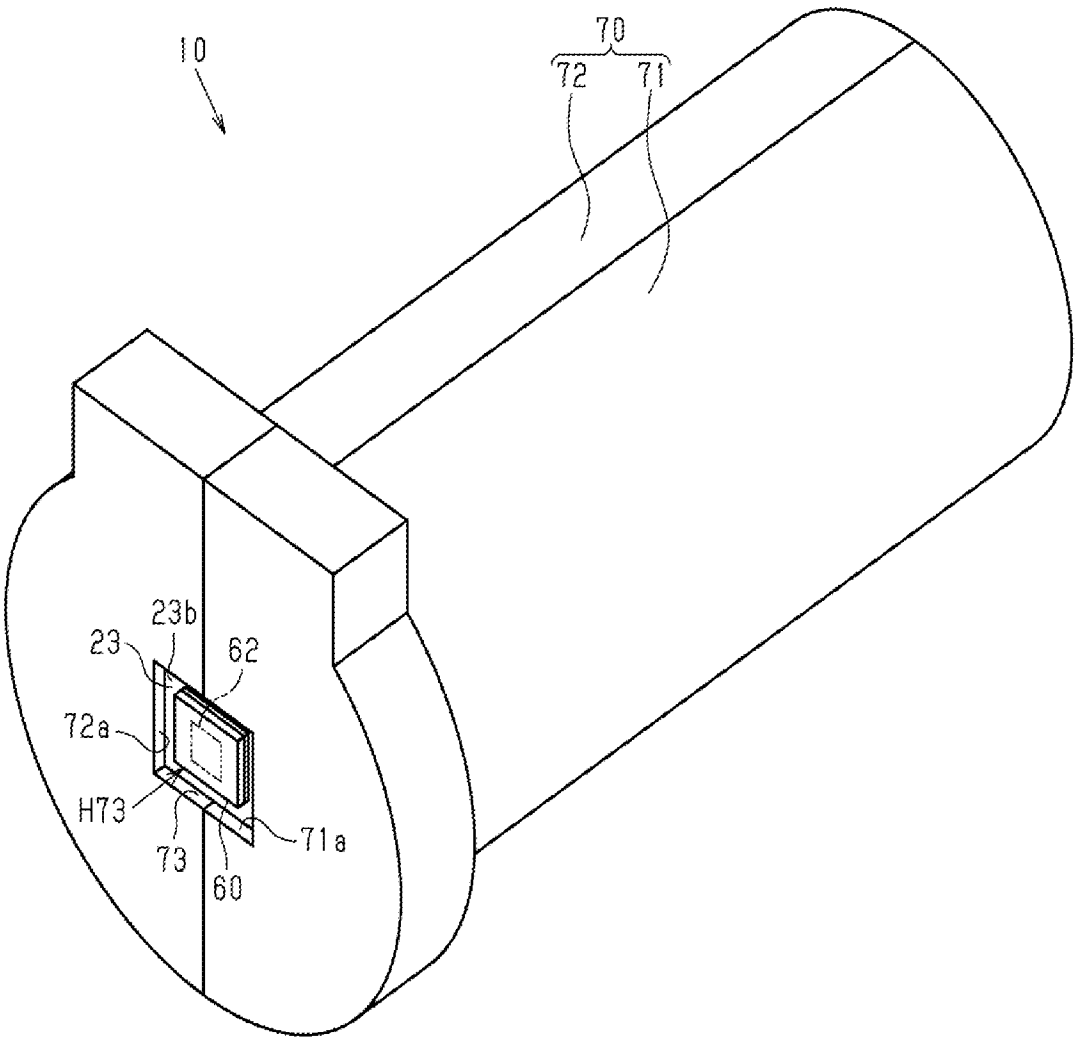
FIG. 2 is a perspective view of the electric compressor according to the first embodiment.

As illustrated in FIGS. 1 and 2, in the present embodiment, the nameplate 60 is a sticker having a rectangular shape and made of a flexible material. The nameplate 60 is caused to adhere to the second surface 23*b* of the third housing member 23 by an adhesive layer 61 formed from an adhesive material. The nameplate 60 is provided on the first outer surface of the outer surface 20*a* corresponding to the inverter accommodation portion.

As indicated by the double-dotted line in FIG. 2, the nameplate 60 includes predetermined information 62. The predetermined information 62 is shown on a surface of the nameplate 60 opposite to the adhesive layer 61. The predetermined information 62 includes, for example, a product number of the electric compressor 10, a lot number of the electric compressor 10 at the time of manufacture, and precautions for use of the electric compressor 10. The predetermined information 62 may be a QR code (registered trademark) including all pieces of the above-mentioned information.

<Configuration of Soundproof Cover>

The soundproof cover 70 is made of an elastically deformable material such as a resin material. The soundproof cover 70 is, for example, made of a urethane material.

Figure 3:
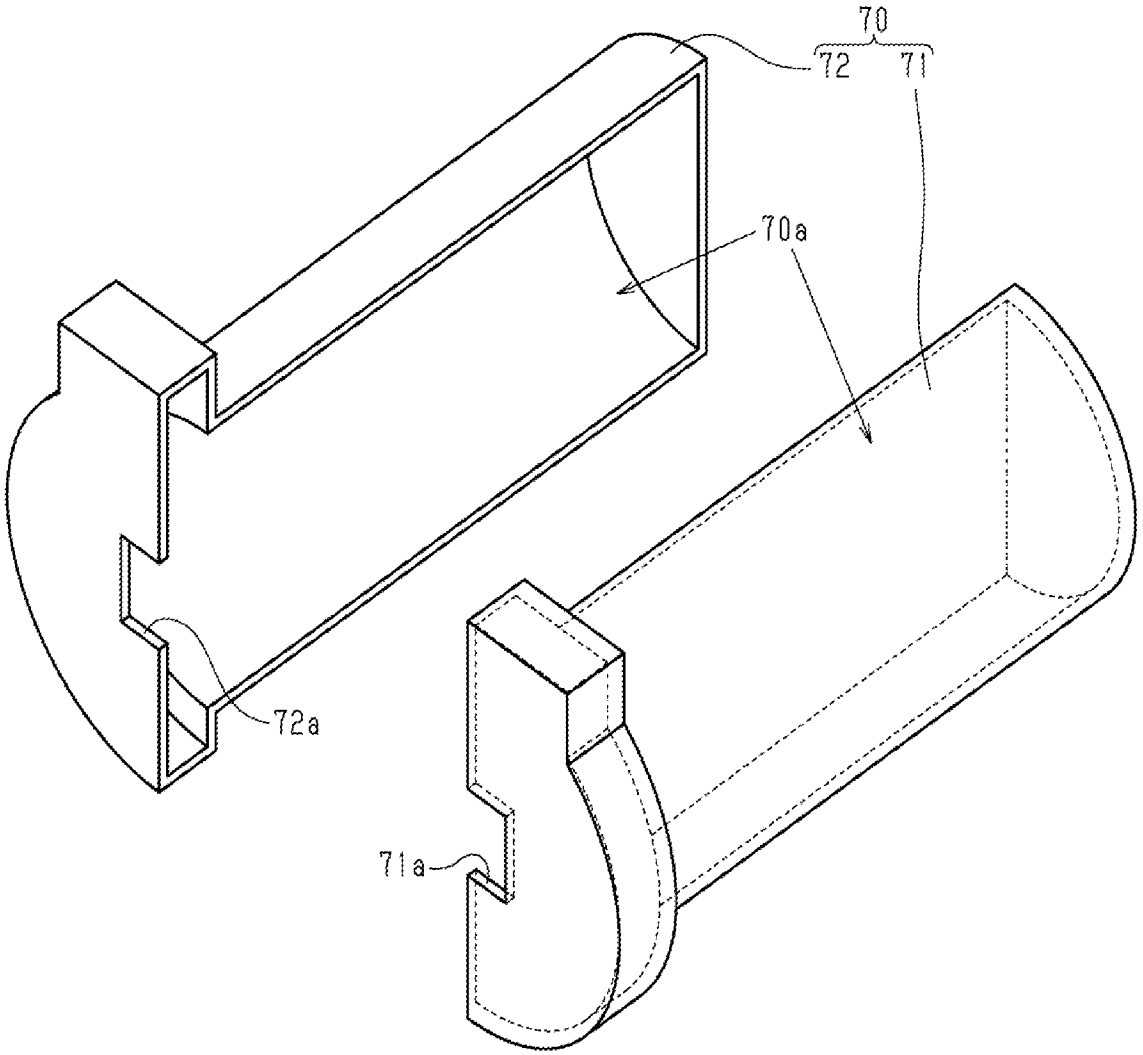
FIG. 3 is a schematic view illustrating a configuration of a soundproof cover according to the first embodiment.

As illustrated in FIGS. 2 and 3, the soundproof cover 70 includes a first cover 71 and a second cover 72. Each of the first cover 71 and the second cover 72 has an accommodation recess 70*a* extending along the outline of the housing 20.

The soundproof cover 70 has a through portion 73 that forms a through hole H73 in the soundproof cover 70. That is, the through portion 73 is a surface forming the through hole H73. The through hole H73 extends through the soundproof cover 70. The through portion 73 and the through hole H73 are disposed across a boundary between the first cover 71 and the second cover 72. The through hole H73 is formed in a part of the soundproof cover 70 corresponding to the nameplate 60.

The through portion 73 has a first cut surface 71*a* and a second cut surface 72*a*. The first cut surface 71*a* is formed in the first cover 71. The second cut surface 72*a* is formed in the second cover 72. The first cut surface 71*a* and the second cut surface 72*a* are continuous to each other.

Figure 4:
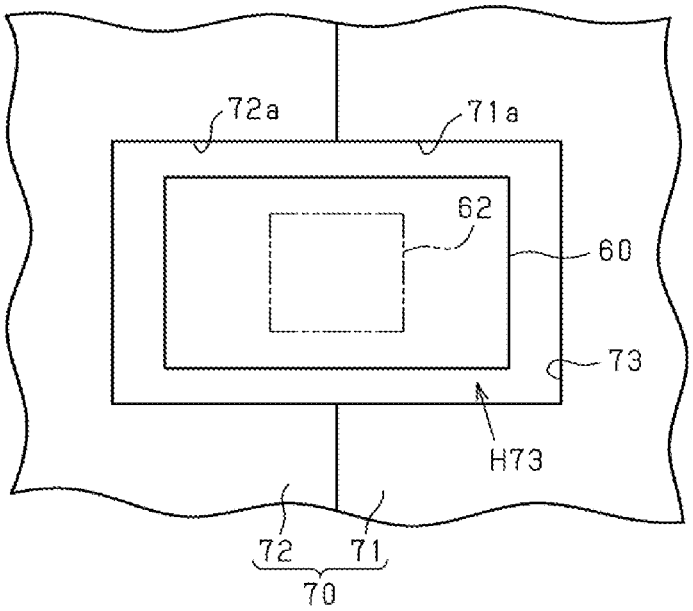
FIG. 4 is a front view for describing a relationship between a nameplate and a through portion.

As illustrated in FIG. 4, the first cut surface 71*a* and the second cut surface 72*a* are spaced from the nameplate 60 at a predetermined distance. The first cut surface 71*a* and the second cut surface 72*a* have a shape extending along an outer edge of the nameplate 60. That is, the through portion 73 has a rectangular shape when the nameplate 60 is viewed in a thickness direction thereof. The through portion 73 surrounds the nameplate 60. The through portion 73 has a shape that extends along the outer edge of the nameplate 60. The predetermined information 62 shown on the nameplate 60 is exposed entirely through the through portion 73. That is, the through portion 73 corresponds to a window through which the nameplate 60 is viewed and which is formed in a part of the soundproof cover 70 corresponding to the nameplate 60. It is noted that the predetermined distance is set so that the size of the through portion 73 does not significantly reduce a noise 10) reduction effect of the soundproof cover 70.

Operation of Embodiment

The following will describe the operation according to the present embodiment.

In the present embodiment, when the compression member 30 and the electric motor 40 operates, noise is generated through the housing 20. However, since the housing 20 is covered with the soundproof cover 70, the noise of the electric compressor 10 is reduced.

The nameplate 60 is attached to the second surface 23*b* of the outer surface 20*a* of the housing 20 made of metal. Thus, the nameplate 60 may be stably attached, as compared with a case where the nameplate 60 is attached to the soundproof cover 70 made of a resin material, for example.

The soundproof cover 70 has the through portion 73 at a position corresponding to the nameplate 60. Thus, a worker can check the nameplate 60 from outside the electric compressor 10 through the through portion 73. In addition, the through portion 73 of the soundproof cover 70 is formed at a position corresponding to the third housing member 23 serving as the inverter accommodation portion. A temperature of the third housing member 23 tends to increase by heat generation of electronic components, and a temperature of the second housing member 22 tends to increase by refrigerant which is compressed and discharged. Thus, the heat from the third housing member 23 is released to the outside through the through portion 73.

The third housing member 23 is a part of the housing 20 where noise is relatively small, as compared with a part of the housing 20 accommodating the compression member 30 and the electric motor 40. Therefore, a loss of the noise reduction effect of the soundproof cover 70 is small even when the through portion 73 is formed in the soundproof cover 70.

Advantageous Effect

The following will describe the effects of the present embodiment.

(1-1) The through portion 73 is disposed at a part of the electric compressor where the temperature tends to be relatively high and the noise is small in such a manner that the nameplate 60 is visible therethrough. This configuration suppresses the loss of the noise reduction effect, increases the heat release performance of the housing 20, permits checking the nameplate 60 from outside, and increases the reliability in attaching the nameplate 60.

(1-2) The through portion 73 surrounds the nameplate 60. The entire nameplate 60 is visible from outside the electric compressor 10 through the through portion 73. Thus, the predetermined information 62 included in the nameplate 60 can be checked appropriately.

(1-3) The through portion 73 has a shape extending along the outer edge of the nameplate 60. This may easily prevent the size of the through portion 73 in the soundproof cover 70 from being increased more than necessary. As a result, the noise reduction effect by the soundproof cover 70 is less likely to be reduced.

(1-4) In attaching the nameplate 60 to the housing 20 with the adhesive layer 61, if the temperature of a part of the housing 20 to which the nameplate 60 is attached is high, the adhesive layer 61 deteriorates. Thus, it is difficult to maintain the adhesive layer 61 stably. In general, when the third housing member 23 and the second housing member 22 are compared, the temperature of the third housing member 23 is lower than the second housing member 22.

In the present embodiment, the nameplate 60 is attached to a part of the housing 20 where the temperature is relatively low. This allows the adhesive layer 61 to be maintained relatively stably when the nameplate 60 is attached to the housing 20 with the adhesive layer 61. As a result, the reliability in attaching the nameplate 60 may be further increased.

Second Embodiment

Figure 5:
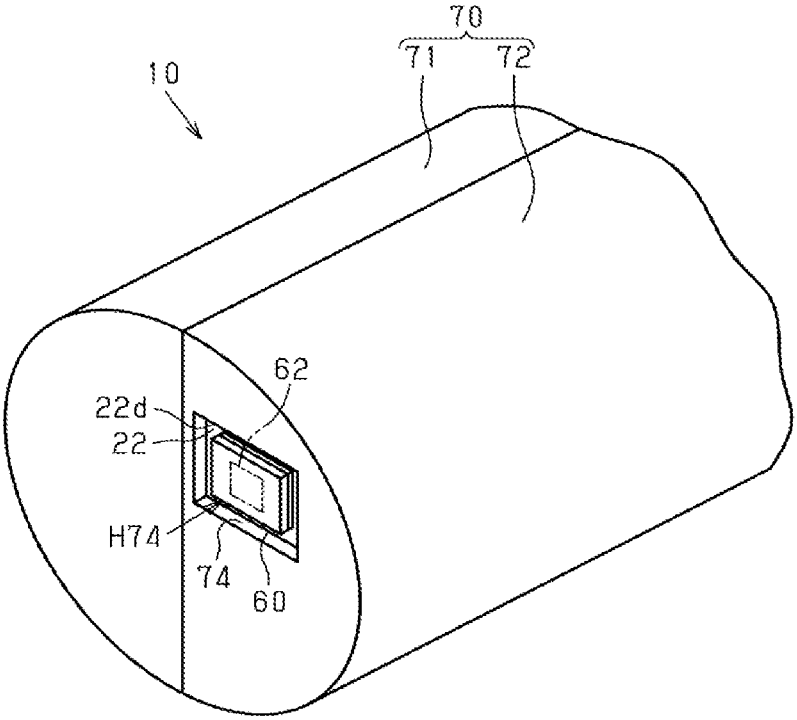
FIG. 5 is a schematic view of an electric compressor according to a second embodiment.

The following will describe an electric compressor according to a second embodiment with reference to FIG. 5. The present embodiment is mainly different from the first embodiment in that the position to which the nameplate is attached is changed. In the following, such a difference will be described in detail. Parts the same as those of the first embodiment will be designated by the same reference numerals and the detailed description thereof will be omitted.

<Position to which the Nameplate is Attached and a Configuration of the Soundproof Cover>

As illustrated in FIG. 5, the nameplate 60 is attached to the outer surface 22*d* of the second housing member 22. The nameplate 60 is provided on the second outer surface of the outer surface 20*a* corresponding to the discharge portion.

The second cover 72 has a through portion 74 that forms a through hole H74 in the second cover 72 of the soundproof cover 70. That is, the through portion 74 is a surface forming the through hole H74. The through hole H74 extends through the soundproof cover 70. The through hole H74 is formed in a part of the soundproof cover 70 corresponding to the nameplate 60. The nameplate 60 is disposed in the through hole H74.

The through portion 74 has the same shape as the through portion 73 of the first embodiment The through portion 74 is spaced at a predetermined distance from the nameplate 60. The through portion 74 has a shape that extends along the outer edge of the nameplate 60. That is, the through portion 74 has a rectangular shape when the nameplate 60 is viewed in a thickness direction thereof. The through portion 74 surrounds the nameplate 60. That is, the through portion 74 corresponds to a window through which the nameplate 60 is viewed and which is formed in a part of the soundproof cover 70 corresponding to the nameplate 60. It is noted that the predetermined distance is set so that the size of the through portion 74 does not significantly reduce a noise reduction effect of the soundproof cover 70.

Operation of Embodiment

The following will describe the operation according to the present embodiment.

The soundproof cover 70 has the through portion 74 at a position corresponding to the nameplate 60. Thus, a worker can check the nameplate 60 from outside the electric compressor 10 through the through portion 74. In addition, the through portion 74 of the soundproof cover 70 is formed at a position corresponding to the second housing member 22 serving as the discharge portion. Thus, the heat from the second housing member 22 is released to the outside through the through portion 74.

Advantageous Effect

The second embodiment offers following advantageous effects, in addition to the effects mentioned in (1-1), (1-2), and (1-3) of the first embodiment.

(2-1) High-temperature and high-pressure refrigerant from the compression member 30 is discharged to the discharge chamber S2. Therefore, the temperature of the second housing member 22 tends to be higher than the that of the third housing member 23, but the heat release performance of the second housing member 22 may be increased by providing the through portion 74. That is, the second housing member 22 may be cooled by the through portion 74. As a result, the adhesive layer 61 may be stably maintained even when the nameplate 60 is attached to the outer surface 22*d* of the second housing member 22. The reliability in attaching the nameplate 60 may be increased while the second housing member 22 is efficiently cooled.

Modification

The aforementioned embodiments may be modified in various manners, as exemplified below. The above embodiments and the following modifications may be combined within a technically consistent range.

In the second embodiment, depending on the position of the nameplate 60 on the outer surface 22*d*, the through portion 74 may be provided in the first cover 71. Alternatively, depending on the position of the nameplate 60 on the outer surface 22*d*, the through portion 74 may be provided so as to be disposed across a boundary between the first cover 71 and the second cover 72.

In the second embodiment, the nameplate 60 may be provided on the outer peripheral surface 22*c* of the peripheral wall 22*b* of the second housing member 22. When this modification is made, the through portion 74 may be provided in the first cover 71, the second cover 72, or across the boundary between the first cover 71 and the second cover 72. That is, in the second embodiment, the nameplate 60 need only be provided on the second surface of the outer surface 20*a* corresponding to the discharge portion.

In the first embodiment, depending on the position of the nameplate 60 on the second surface 23*b*, the through portion 73 may be provided only in the first cover 71, or the second cover 72.

In the first embodiment, the nameplate 60 may be provided on the third surface 23*c* or the exposed surface 23*d*. When this modification is made, the through portion 73 may be provided in the first cover 71, the second cover 72, or across the boundary between the first cover 71 and the second cover 72. That is, in the first embodiment, the nameplate 60 may be provided on the first outer surface of the outer surface 20*a* corresponding to the inverter accommodation portion.

In the embodiments, a plurality of nameplates 60 may be provided. When two or more nameplates 60 are provided in the first embodiment, the nameplates 60 may be provided on the second surface 23*b*, the third surface 23*c*, and the exposed surface 23*d* as appropriate. In this case, the number of the through portions 73 the same as the number of the nameplates 60 is preferably provided in the soundproof cover 70.

When two or more nameplates 60 are provided in the second embodiment, the nameplates 60 may be provided on the outer peripheral surface 22*c* and the outer surface 22*d* as appropriate. In this case, the number of the through portions 74 the same as the number of the nameplates 60 is preferably provided in the soundproof cover 70. It is noted that the number of the through portions 73 and the number of the through portions 74 is preferably set to the number that does not significantly reduce the noise reduction effect of the soundproof cover 70.

When a plurality of nameplates 60 is provided in the above embodiments, one of the nameplates 60 may be provided on one of the second surface 23*b*, the third surface 23*c*, and the exposed surface 23*d*, and another one of the nameplates 60 may be provided on one of the outer peripheral surface 22*c* and the outer surface 22*d*. For example, when two nameplates 60 are provided, one of the nameplates 60 may be provided on the second surface 23*b* and the other of the nameplates 60 may be provided on the outer surface 22*d*. That is, the nameplates 60 need only be provided on at least one of the first outer surface corresponding to the inverter accommodation portion and the second outer surface corresponding to the discharge portion in the outer surface 20*a*. It is noted that "at least one of the first outer surface and the second outer surface" includes "only in the first outer surface," "only in the second outer surface," and "in both of the first outer surface and the second outer surface."

Although the nameplate 60 is a sticker in the above embodiments, the nameplate 60 may be made of a metal plate. In this case, the nameplate 60 may be fixed to the housing 20 using a fixing member such as a bolt. When the nameplate 60 is fixed with the fixing member, the adhesive layer 61 may be omitted.

In the embodiments, the shape of the nameplate 60 is not limited to a rectangular shape, but may be changed appropriately. When the shape of the nameplate 60 is changed, the shapes of the through portion 73 and the through portion 74 are preferably changed so as to extend along the outline of the nameplate 60.

In the embodiments, the through portion 73 and the through portion 74 need not have a shape extending along the outer edge of the nameplate 60. For example, the through portion 73 and the through portion 74 may have a circular shape, as viewed in the thickness direction of the nameplate 60. Even when the shapes of the through portion 73 and the through portion 74 are changed in this manner, the through portion 73 and the through portion 74 preferably surround the nameplate 60.

In the embodiments, the through portion 73 and the through portion 74 need not necessarily surround the nameplate 60. In other words, the through portion 73 and the through portion 74 may be smaller than the nameplate 60. When this modification is made, the through portion 73 and the through portion 74 are preferably formed so that the predetermined information 62 on the nameplate 60 can be seen therethrough.

In the above embodiments, the first housing member 21 and the third housing member 23 may formed integrally. In this case, the exposed surface 23*d* is a surface integrally continuous with the outer peripheral surface 21*c* of the peripheral wall 21*b*.

The third housing member 23 need not necessarily have a shape that projects out in the radial direction B relative to the first housing member 21. For example, the shape of the third housing member 23 may be changed so that the entire area of the first surface 23*a* of the third housing member 23 is in contact with the end wall 21*a* of the first housing member 21. That is, the first surface 23*a* need not necessarily include the exposed surface 23*d*. When the first surface 23*a* does not include the exposed surface 23*d*, the first outer face of the outer surface 20*a* corresponding to the inverter accommodation portion corresponds to the second surface 23*b* and the third surface 23*c*.

In the above embodiments, the compression member 30 is not limited to the scroll type, but may be a piston type or a vane type.

Although the soundproof cover 70 includes the first cover 71 and the second cover 72 in the above embodiments, the soundproof cover 70 may include three or more covers.

In the above embodiments, the soundproof cover 70 may be formed of any material as long as it provides soundproofing effects. The material of the soundproof cover 70 is not limited to a resin material such as a urethane material, but may be unwoven cloth or the like. The soundproof cover 70 may have a two layered structure or a three layered structure that has, for example, an inner layer is made of urethane and an outer layer is made of a resin material other than urethane.

In the embodiments, the electric compressor 10 may be mounted to a fuel cell vehicle and configured to compress air as fluid to be supplied to a fuel cell with the compression member 30.

What is claimed is:

1. An electric compressor comprising:

a compression member configured to compress fluid drawn from a suction chamber and discharge the compressed fluid to a discharge chamber;

an electric motor configured to drive the compression member;

an inverter configured to drive the electric motor;

a housing in which the suction chamber and the discharge chamber are formed and that accommodates the compression member, the electric motor, and the inverter;

a soundproof cover covering an outer surface of the housing; and at least one nameplate including predetermined information, the housing including:

an inverter accommodation portion accommodating the inverter, and a discharge portion forming the discharge chamber, wherein the at least one nameplate is provided on either one of a first outer surface of the outer surface and a second outer surface of the outer surface, wherein the first outer surface corresponds to the inverter accommodation portion and the second outer surface corresponds to the discharge portion, and the soundproof cover has at least one window through which the at least one nameplate is viewed, the at least one window being formed in a part of the soundproof cover corresponding to the at least one nameplate.

2. The electric compressor according to claim 1, wherein the at least one window surrounds the at least one nameplate.

3. The electric compressor according to claim 2, wherein the at least one window has a shape extending along an outer edge of the at least one nameplate.

4. The electric compressor according to claim 1, wherein the at least one nameplate is provided on the first outer surface.

5. The electric compressor according to claim 1, wherein the soundproof cover covers substantially an entire outer surface of the housing.

6. The electric compressor according to claim 1, wherein the at least one nameplate directly abuts the outer surface.

7. The electric compressor according to claim 1, wherein the at least one nameplate abuts the outer surface via an adhesive.

* * * * *